United States Patent [19]

Fleming

[11] Patent Number: 4,667,607

[45] Date of Patent: May 26, 1987

[54] HEATING

[75] Inventor: John S. Fleming, Auckland, New Zealand

[73] Assignee: Kent Heating Limited, Auckland, New Zealand

[21] Appl. No.: 802,822

[22] Filed: Nov. 29, 1985

[30] Foreign Application Priority Data

Nov. 28, 1984 [NZ] New Zealand ..... 210367

[51] Int. Cl.[4] ..... F23J 1/02

[52] U.S. Cl. ..... 110/172; 110/173 R; 126/200

[58] Field of Search ..... 126/200; 110/172, 173 R; 99/341

[56] References Cited

U.S. PATENT DOCUMENTS 4,048,978 9/1977 Plumat et al. ..... 126/200

4,382,177 5/1983 Heamey ..... 126/200 X 4,455,479 5/1984 Itoh et al. ..... 126/200 X

*Primary Examiner*—Edward G. Favors

*Attorney, Agent, or Firm*—Holman & Stern

[57] ABSTRACT

A heating appliance having which a viewport through which combustion can be viewed incorporating a portion which is reflectorized to reflect some of the radiant heat of the burning fuel in the fire chamber back into the fire chamber to maintain high temperatures in the fire chamber for efficient combustion while reducing the temperature of the outer surface of the viewport and accordingly the likelihood of injury to persons accidentally touching the viewport and the possible damaging effects of thermal exposure and shock. The viewport is reflectorized in the preferred embodiment by a treatment which enhances the reflectivity of the transparent or translucent portion over that of transparent glass.

24 Claims, 5 Drawing Figures

B
O
2
1
4
I
B
6
11
10

HEATING

BACKGROUND OF THE INVENTION

1. Field of the Invention

This invention relates to improvements in and relating to heaters and more particularly to a heater casing formation which can provide "visual flame" characteristics.

2. Description of the Prior Art

"Visual flame" characteristics enable the burning fuel to be seen from outside the heater usually through a transparent or translucent portion of the heater. Open fires are in the main inefficient in converting solid fuels to useful heat, are expensive and difficult to install in a building and can be the cause of dirt, dust and smoke in a building.

So called enclosed solid fuel burning appliances, such as those with a fire chamber assembly, controlled air inlet and controlled combustion can provide very efficient burning of fuel, (for example coal, coke, timber and the like), however, many are unable to satisfactorily provide the desirable "visual flame" characteristics of an open fire.

Attempts have been made to meet the problem of providing an enclosed solid fuel burning appliance having "visual flame" characteristics by providing a small viewport or glass window, typically, in a front door of the fire chamber assembly. However, various problems have been experienced with such configurations, including cracking of the viewport both due to mechanical and thermal effects as well as obscuring of the glass by soot, smoke and products of fuel combustion.

Particularly the viewport tends to become obscured by condensation deposits forming on an inner face of the viewport, those deposits subsequently become burnt on in the manner of a sticky deposit, to which dust and smoke particles adhere. Creosote is one of the deposits often left when burning timber.

Various elaborate means have been devised in attempts to provide a non-cracking and clean viewport, such as the provision of a buffer zone of clean inlet air between the viewport and the fuel or fire, however, while a few of these structures have been successful on a small viewport, heaters have the appearance of an enclosed stove with a "port hole" through which the fire can be viewed. This is regarded by the applicant as less than desirable.

Most, if not all solid fuel heating arrangements require a non combustible and insulating floor protector, to reduce the likelihood of damage to a floor or floor coverings in front of the apparatus to reduce the deleterious effect of radiant heat in that area. Traditionally, the floor protector is provided by means of a hearth. Where there is a viewport, there is an increased possibility of heat radiating from the appliance and therefore, there is a need for the floor protector to be somewhat thicker and larger than the applicant considers desirable. This can cause obstruction, can lead to a restriction in convenient placement of the heater and is also expensive.

When not in operation the interior of the fire chamber of a solid fuel heating means is readily visible, either through the fire opening in the case of an open fire, or through a viewport in the case of a ported enclosed solid fuel stove. This is less than desirable, aesthetically. Attempts have been made to provide a visual screen to obscure the interior of the fire from view however, these have been essentially mechanical in their arrangement and have led to increased costs, maintenance problems and in some cases the screens have been difficult to use.

In operation of an enclosed solid fuel heater, there is, furthermore, a natural conflict of requirements. In the first instance, it is desirable for efficient burning of the fuel in the fire chamber for the interior of the fire chamber (including the surfaces of the fire chamber) to be as hot as possible so as to achieve efficient pyrolisis and furthermore, to burn off any creosote deposits which have formed on the inside of the fire chamber or to prevent creosote and other deposits of combustion forming thereon.

It is furthermore desirable for at least the outside portions of the heater exposed where they can be touched to be as cool as possible to reduce the likelihood of injury or damage of the viewport due to thermal shock and the like. Historically, there have been substantial difficulties in achieving the required compromise and as operation of the heater is the more important requirement, there has been a tendency for the outer exposed surfaces of the fire chamber to be somewhat hotter than is desirable or safe, especially when the heater is in high output mode.

BRIEF SUMMARY OF THE INVENTION

It is an object of this invention to overcome the abovementioned problems.

According to one aspect of this invention there is provided a heating apparatus including a fire chamber assembly in which fuel can be burned, said fire chamber assembly having a transparent or translucent portion forming at least part of said fire chamber assembly, said transparent or translucent portion at least partially reflectorized to enhance any reflective properties of said transparent or translucent portion for reflection of radiant heat originating in the fire chamber back into the fire chamber assembly.

A further object of the invention is to provide the transparent or translucent portion at least partially reflectorized by mirroring.

A still further object is to provide the transparent or translucent portion reflectorized by the inclusion on a radiant heat reflecting element or elements in, or or adjacent to at least a part of the transparent or translucent portion.

Another object of the invention is to provide the reflectorization by a plurality of separated reflectorized portions.

An additional object of the invention is to provide the reflectorization on an inwardly facing portion of the transparent or translucent portion.

A further object is to provide the reflectorization on or adjacent to an outer surface portion of the transparent or translucent portion.

Another object is to provide the transparent or translucent portion in at least two portions positioned adjacent each other wherein the reflectorization is positioned between at least one and another of the adjacent portions of the transparent or translucent portion.

A still further object is to provide the transparent or translucent portion is provided with at least two portions, an inner portion provided in a high temperature resistant material and a further portion mounted outwardly of the inner portion and having a higher mechanical impact strength than the high temperature resistant inner portion.

An additional object is to provide a heating apparatus wherein remaining portions of the fire chamber assembly excluding the transparent or translucent portion are heat insulated.

The invention is, in a preferred embodiment, provided as a solid fuel heating appliance preferably formed in suitable durable heat resistant material such as a combination of steels, glass, ceramics and insulating materials, to define preferably a fire chamber assembly accessible via an openable door to enable the placement of fuel in the fire chamber assembly.

Preferably a controllable air inlet is provided communicating with the fire chamber assembly to enable air to be passed to the fuel to facilitate combustion. Further, a flue is provided to facilitate the exhausting of combustion gases from the fire chamber assembly in operation of the device.

In the preferred form of the invention one whole wall of the fire chamber assembly provides the "viewport", which also doubles as a door for the fire chamber; however, in alternative embodiments of the invention the viewport may be provided in an alternative wall to the door. The actual construction of the fire chamber of the preferred embodiment is in no way essential to the invention.

The invention includes enhanced reflectorization of the viewport. In the preferred embodiment, a partial reflectorization of the viewport is desirable so that radiant heat emanating from the fire tends to be at least partially reflected back into the fire chamber to maintain higher temperatures in the fire chamber assembly than would normally be encountered without reflectorization; this furthermore, reduces the outside temperature of the viewport to reduce the likelihood of thermal shock, injury through contact with the glass and the need for a large thick hearth or floor protector in front of the viewport.

While heating units having a viewport have enjoyed some small degree of reflectorization inherent in the glass of the viewport, by enhancing the reflectorization of the viewport a substantially increased inner surface temperature of the viewport is able to be achieved while outer surface temperatures are reduced, thus facilitating greater efficiency in pyrolization and furthermore, the ability to burn off or prevent the depositing of combustion residue on and resultant obscuring of the viewport yet enabling the "visual flame" properties desired. While the unit is not in operation, the reflectorization sufficiently diffuses vision through the viewport to prevent or reduce the viewing of unsightly residues of fuel, ash and the like.

The greater efficiency of the combustion enables the heating apparatus to more readily comply with emission limits set by various regulatory authorities which is a prime topical concern for manufacturers of solid fuel burning appliances.

For the purposes of clarity, the term "reflectorized" is defined as being a treatment, surface, element, layer or other property of the transparent or translucent portion of the fire chamber assembly which enhances the reflectivity of the transparent or translucent portion over that of transparent glass.

BRIEF DESCRIPTION OF THE DRAWINGS

The preferred embodiment of the invention will now be described with reference to the accompanying drawings wherein.

DETAILED DESCRIPTION

The preferred form of the invention described in relation to the drawings, is a solid fuel burning appliance intended for use as either a freestanding or built-in heater in a building, such as in a domestic situation; however, the invention is to be understood as not being limited to such an arrangement and in alternative forms of the invention, it is envisaged that the invention can apply to other forms of heating appliance using either solid or fluid fuels, as may be appropriate.

The apparatus in this form of the invention is preferably constructed of suitable material such as steel plate and similar temperature resistant material as well as utilizing various transparent or translucent materials such as clear or semi-clear glass, ceramics, temperature resistant glass and other temperature resistant transparent or translucent materials.

Figure 1:
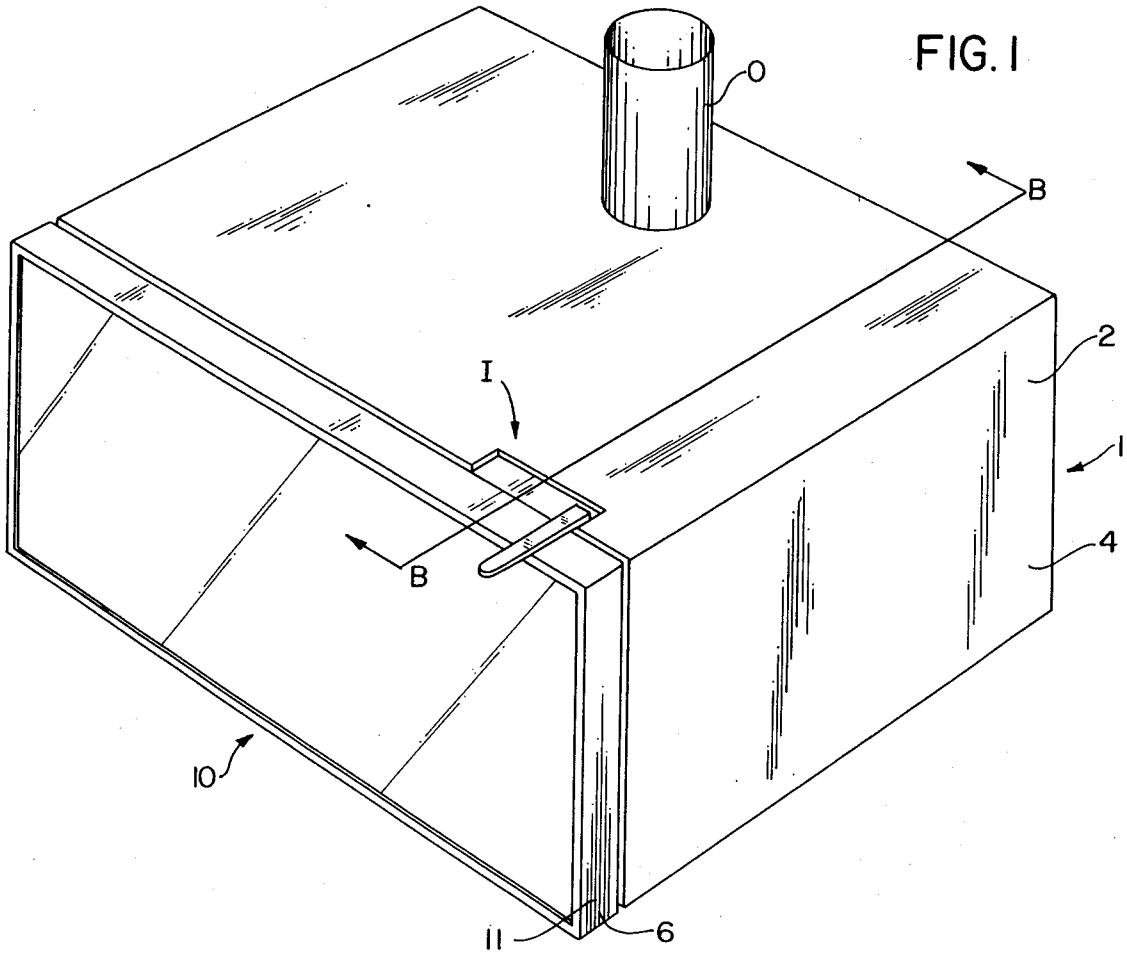
FIG. 1 is a schematic perspective view of the invention according to one preferred embodiment.
Figure 2:
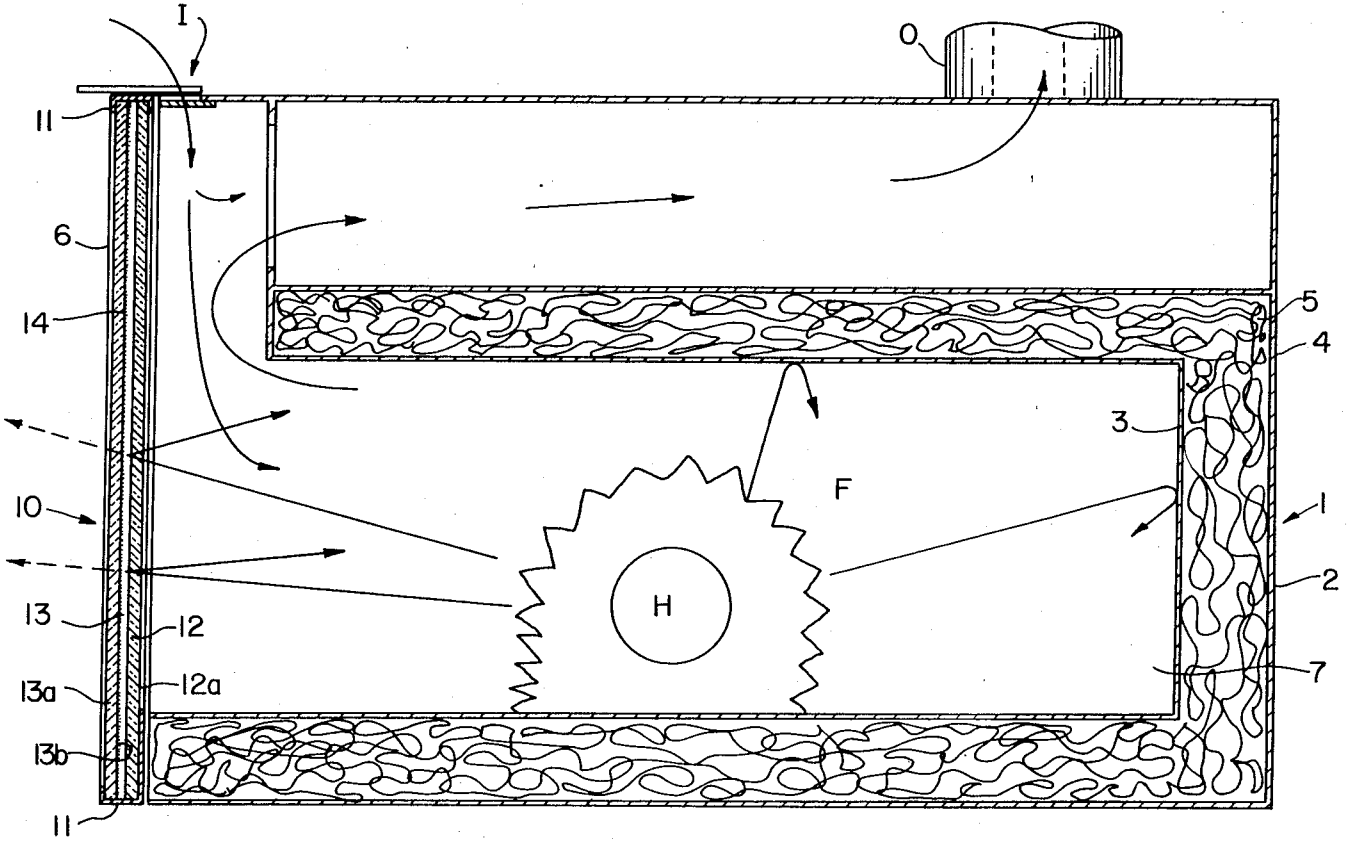
FIG. 2 is a cross sectional view of the apparatus of FIG. 1 taken along line BB showing fuel burning in the fire chamber and the transparent or translucent panel in cross-section.

Referring particularly to FIGS. 1 and 2, the heating apparatus as generally indicated by arrow 1 preferably defines a fire chamber assembly 2 which is mountable in a building either "built-in" within an existing open fireplace or in a cavity formed in the building structure, or alternatively, as a freestanding unit.

Preferably portions of a floor, roof and side and rear walls of fire chamber assembly 2 are provided in a substantially double skinned sheet metal configuration. A robust durable and heat resistant inner casing 3 is positioned within an outer casing 4 positioned spaced from the inner casing 3, heat insulating material 5 such as, for example, ceramic fiber or glass or other non combustible materials being provided in the cavity defined between the inner casing 3 and outer casing 4 to insulate said outer casing 4. In alternative forms an air gap may be sufficient heat insulation.

The fire chamber assembly 2 in this form of the invention preferably has a closure 6 provided as a front wall. The closure 6 is preferably hinged adjacent one edge (perferably a side edge) to remaining portions of the fire chamber assembly 2 and is able to be secured via catches across an open front defined by the remaining portions so as to enable access to a cavity 7 defined in the inner casing 3.

The closure 6 is in this preferred form of the invention provided as the whole frontal portion of the fire chamber assembly 2 as shown FIG. 1 although this is in no way essential to the invention.

Construction of the closure 6 will be described hereinafter; however, it will be appreciated that when closed, the closure 6 substantially completes the cavity 7 within which fuel F can be positioned for combustion. A suitable controlled air inlet I and a outlet O is provided to enable combustion of the fuel F to take place and for heat H to be generated.

The closure 6 includes a transparent or translucent portion 10 across a majority of its surface of sufficient clarity to provide some "visual flame" characteristics in the apparatus in use yet of sufficient density to reduce vision into the cavity 7 when there is no flame.

While the invention is described with reference to the front portion on the fire chamber assembly 2 being provided as the transparent or translucent portion and in addition, to provide a closure for an opening into the fire chamber 3, this is in no way essential to the invention and in alternative arrangements it is envisaged that transparent or translucent portion 10 can be provided in an alternative portion or portions of the fire chamber assembly 2, or for a closable opening to be provided separately of the transparent or translucent portion 10. It is however generally convenient to construct the fire chamber assembly 2 to have the transparent or translucent portion 10 and the closure 6 in the same structure.

In this form of the invention, preferably a small peripheral frame portion 11 is provided about the outer edge of the panel 10 to facilitate engagement of the panel 10 with closure 6 hinges, door catches and the like.

Preferably the transparent or translucent panel portion 10 is provided according to the arrangement of FIG. 2 which shows the panel 10 in cross-section.

In the preferred form of the invention, an inner face sheet 12 of the panel 10 is provided by a sheet of high temperature and thermal shock resistant material such as clear glass material (such as is known in the trade as "Vycor" brand 96% silica glass) which has a high temperature resistance to thermal shock. Another surface sheet 13 of the panel 10 is also preferably provided in a high temperature resistance material but which may have a thermal resistance somewhat less than the material forming the inner sheet 12, e.g. a material such as tempered glass.

The arrangement allows the outer sheet 13 to have a higher mechanical impact strength than inner sheet 12 as glass materials with high temperature ratings usually have relatively low mechanical impact strengths.

The transparent or translucent panel 10 is thus able to withstand high temperatures adjacent the inner face **12*a*** and yet have mechanical impact strength to guard against damage in use such as being accidentally bumped or kicked.

In addition, preferably at least part of an outer surface **13*b* of the outer sheet 13 is reflectorized, for example by the deposit, such as by vacuum deposit, metal spraying or depositing by electrical means, particles, spots or strips of one or more reflector materials such as chromium, aluminum, or a metal alloy or oxide on to the inner surface 13*b* to thus provide at least partial reflectorization of said panel 10 to reflect some radiant heat originating from the fuel in the caviy 7 back into the fire cavity 7**.

In the preferred form of the invention the reflectivity is preferably up to approximately 75% of the radiant heat to which it is exposed to from an interior of the fire chamber. However, this is in no way limiting and it will be appreciated that the extent of reflectorization can be varied to suit use conditions and heater constructions.

The preferred embodiment of the invention provides for the reflectorization to be provided to a level whereby to a person viewing the transparent or translucent portion, from the outside when the fire is in operation, the flame is readily visible yet when the apparatus is not in operation the reflectorization prevents the person readily seeing into the fire chamber. To achieve this result, it is preferred that the reflectorization is provided in the form of a screen matrix, or plurality of disbursed particles mounted adjacent, applied to, or embedded in or below the surface of the portions forming the transparent or translucent panel 10. Alternatively, the reflectorization can be provided as a thin metal or oxide deposit sufficient to achieve the desired extent of reflectorization.

Figure 3:
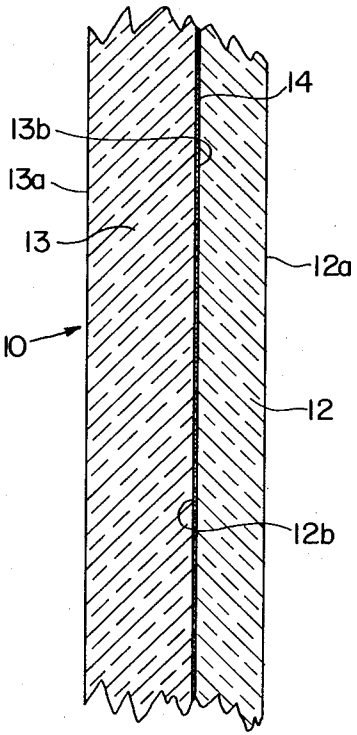
FIG. 3 is an enlarged cross-sectional view through the transparent or translucent portion in an alternative embodiment.

Referring particularly to FIGS. 2 and 3, it will be appreciated that in operation, heat generated from combustion of the fuel F dissipates outwardly of the fire chamber assembly 2. Some of the radiant heat which contacts the transparent or translucent panel 10 is reflected back but a proportion passes through the transparent or translucent portion 10 and outwardly to heat the room.

It will be appreciated that some of the radiant heat reflected back into the cavity 7 is absorbed by portions of the transparent or translucent panel 10 situated inwardly of the reflectorization causing those portions to heat up to thus maintain the inner surface **12*a* at a substantially higher temperature than that of the outer surface 13*a*. It is preferred, that a normal running temperature of the inner surface 12*a* is above the normal condensing temperature of creosote and other combustion products which cause staining or other obscuration of the inner surface 12*a***. It will also be appreciated that the high surface temperature will burn off any deposits occurring during a lighting phase, or before the unit has achieved a stable normal operation.

A normal running temperature at which the inner surface **12*a* operates is effectively able to be controlled by the extent of insulation which is applied to the remaining portions of the fire chambers assembly 2 (other than the transparent or translucent panel 10) and the extent of reflectorization in the panel 10** together with the air supply and fuel combustion rate.

The invention has been described with reference to the sandwiching of the reflectorization between sheets forming the transparent or translucent panel 10; that is between the inner and outer sheets 12 and 13, which has the effect of protecting the reflectorization from mechanical damage. In alternative assemblies, the reflectorization can be provided on or adjacent the inner or outer surfaces **12*a*, 12*b* or 13*a***.

Referring to FIG. 3, a simplified form of transparent or translucent panel 10 is provided where the inner sheet 12 and outer sheet 13 are substantially juxtaposed and sandwiched therebetween is the reflectorization 14. In this form of the invention, the reflectorization 14 can be provided either by a coating applied to one or the other of the opposing adjacent surfaces of the sheets 12 or 13 or alternatively, by the installation of a screen matrix or other element such as perforated metal sheet or foil providing the at least partial reflectorization between the opposing surfaces of the inner and outer sheets 12 and 13.

Figure 4:
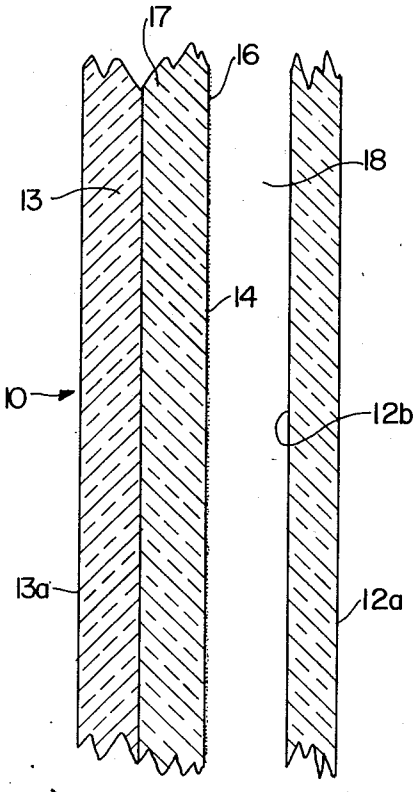
FIG. 4 is a view similar to FIG. 3 showing a further alternative transparent or translucent panel portion of a further embodiment of the invention.

Turning particularly to FIG. 4, this assembly shows the panel 10 reflectorized at 14 on an inwardly facing surface 16 of a mid panel 17 with a cavity 18 defined between the reflectorized 14 and surface 12*b* of the inner panel 12. It will be appreciated that in this assembly, the additional insulation provided by the cavity 18 further facilitates the maintenance of the inner surface 12*a* at high temperatures during use to avoid condensation of combustion products and the outer surface 13*a* at lower temperatures.

Figure 5:
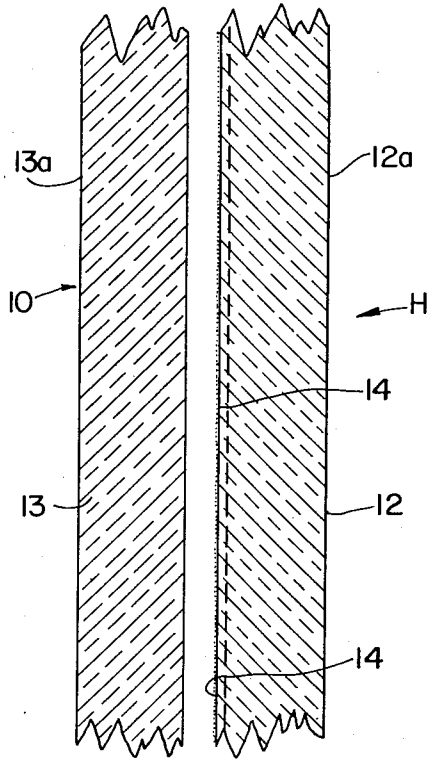
FIG. 5 is a view similar to FIG. 3 showing a further alternative transparent or translucent panel portion of a further embodiment of the invention.

Referring now to FIG. 5, a further embodiment of the invention is provided whereby the reflectorization is shown to be provided as treatment particles or a screen matrix embedded in a portion of the inner sheet 12 such as during formation of the inner sheet 12. This is the preferred embodiment of the invention where reflectorization is embedded into the sheets forming the panel 10 however, in an alternative embodiment of the invention, the reflectorization 14 can also be provided in the sheet 13.

While reflectorization is described in this form of the invention as being in the form of a substantially mirrored surface using materials such as chromium, nickel, aluminum or metal alloy or oxide treatments, it will be appreciated that in alternative forms of the invention. other reflectorization materials may be utilized such as those where the proportion of the incident radiant heat reflected varies in respect of certain radiant heat wavelengths to enable selective reflection of radiant heat back into the cavity 7; e.g. materials such as particles, screens, sheets, films, layers and the like having reflective properties.

Additionally the reflectorization of the embodiments of FIGS. 2, 3 and 4 are not necessarily mounted on a "surface" of the transparent or translucent panel 10, but are alternatively self supporting or otherwise supported for positioning adjacent elements forming the transparent or translucent panel 10.

In a still further embodiment of the invention, the transparent or translucent portion 10 can be provided in a single panel when the panel 10 is treated so as to provide the reflectorization. This arrangement is particularly suited where the reflectorization is either protected by being embedded in the sheet material, such as as has been described with reference to FIG. 5 or alternatively, where the reflectorization is sufficiently robust to withstand the rigors of use. It is preferred, although not essential, that the reflectorization in this arrangement be provided either on or adjacent the innermost surface of the transparent or translucent portion 10. However, in an alternative embodiment of this form of the invention, the reflectorization can be provided at or near an outer surface of the transparent or translucent panel portion, even though this is less effective than the arrangement described hereinbefore.

It will be appreciated that by ensuring that the insulation applied to remaining portions of the fire chamber assembly 2 and the reflectorization of the transparent or translucent portion 10 are sufficient to ensure that heat transfer from the cavity 7 is sufficiently low under normal operating conditions the inner surface 12*a* temperature is higher than the temperature at which deposits of combustion condense on to said inner surface 12*a*.

An additional advantage of the present arrangement is that the outer surface 13*a* of the transparent or translucent portion 10 is maintained at a lower temperature than it would have been without the reflectorization 14, thus reducing the likelihood of injury through burning should a person accidentally touch the outer surface 13*a*.

Thus, by this invention there is provided an improved firebox for a heater.

I claim:

1. In a solid fuel fuelled heating apparatus including a fire chamber having a surrounding wall portion in whcih solid fuel can be burned, and a transparent or translucent window portion forming at least a part of said fire chamber wall portion, the improvement comprising:

means for at least partially reflectorizing said window portion at a position substantially outwardly, with respect to the chamber, of an inner surface of said window portion to enhance reflective properties of said window portion for reflecting a sufficient portion of all radiant heat originating in the fire chamber in use to maintain said inner surface at a temperature sufficiently high to reduce deposits of combustion products on said window portion and resultant obscuration of said window portion in normal operation.

2. A heating apparatus as claimed in claim 1 wherein said reflectorizing means comprises:

at least partially mirroring said window portion.

3. A heating apparatus as claimed in claim 1 wherein said reflectorizing means comprises:

a coating on a surface portion of said window portion.

4. A heating apparatus as claimed in claim 2 wherein said reflectorizing means comprises:

a coating on a surface portion of said window portion.

5. A heating apparatus as claimed in claim 2 wherein said reflectorizing means comprises:

a treatment on a surface portion of said window portion.

6. A heating apparatus as claimed in claim 3 wherein said coating comprises:

a sprayed-on coating.

7. A heating apparatus as claimed in claim 5 wherein said coating comprises:

a sprayed-on treatment.

8. A heating apparatus as claimed in claim 5 wherein said treatment comprises:

vacuum depositing.

9. A heating apparatus as claimed in claim 1 wherein said reflectorizing means comprises:

a reflective screen matrix provided in said window portion.

10. A heating apparatus as claimed in claim 1 wherein said reflectorizing means comprises:

a reflective screen matrix provided on said window portion.

11. A heating apparatus as claimed in claim 1 wherein said refectorizing means comprises:

a reflective screen matrix provided adjacent portions forming said window portion.

12. A heating apparatus as claimed in claim 1 wherein said reflectorizing means comprises:

metal.

13. A heating apparatus as claimed in claim 1 wherein said reflectorizing means comprises:

metal oxides.

14. A heating apparatus as claimed in claim 12 wherein said metal comprises:

aluminum, nickel, chromium, or alloys thereof.

15. A heating apparatus as claimed in claim 1 wherein:

said window portion comprises at least two sheet members positioned substantially parallel and adjacent each other; and said reflectorizing means is positioned between said adjacent sheet members.

16. A heating apparatus as claimed in claim 15 wherein:

said at least two sheet members comprise an inner sheet member and an outer sheet member; and said reflectorizing means is provided on an inwardly facing surface of said outer sheet member.

17. A heating apparatus claimed in claim 15 wherein:

said at least two sheet members comprise an inner sheet member and an outer sheet member; and said reflectorizing means is provided adjacent to an inwardly facing surface of said outer sheet member.

18. A heating apparatus as claimed in claim 15 wherein:

said at least two sheet members comprise an inner sheet member and an outer sheet member; and said reflectorizing means is provided on an outer surface portion of said inner sheet member.

19. A heating apparatus as claimed in claim 15 wherein:

said at least two sheet members comprise an inner sheet member and an outer sheet member; and said reflectorizing means is provided adjacent to an outer surface portion of said inner sheet member.

20. A heating apparatus as claimed in claim 15 and further comprising:

a cavity defined between at least some of said sheet members forming said window portion.

21. A heating apparatus as claimed in claim 18 and further comprising:

a cavity defined between said inner and outer sheet members.

22. A heating apparatus as claimed in claim 17 and further comprising:

a cavity defined between said inner and outer sheet members.

23. A heating apparatus as claimed in claim 1 wherein said window portion comprises:

an inner sheet member of high temperature resistant material; and an outer sheet member mounted outwardly of said inner sheet member with respect to said fire chamber and having a higher mechanical impact strength than said inner sheet member.

24. A heating apparatus as claimed in claim 1 wherein:

remaining portions of said fire chamber other than said window portion are insulated to retain heat in said fire chamber.

* * * * *